US009460693B2

(12) United States Patent
Mynatt

(10) Patent No.: US 9,460,693 B2
(45) Date of Patent: Oct. 4, 2016

(54) GUITAR STRAP

(71) Applicant: Craig Mynatt, Pleasanton, CA (US)

(72) Inventor: Craig Mynatt, Pleasanton, CA (US)

( * ) Notice: Subject to any disclaimer, the term of this patent is extended or adjusted under 35 U.S.C. 154(b) by 0 days.

(21) Appl. No.: 14/984,030

(22) Filed: Dec. 30, 2015

(65) Prior Publication Data

US 2016/0189695 A1 Jun. 30, 2016

Related U.S. Application Data

(60) Provisional application No. 62/097,912, filed on Dec. 30, 2014.

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS 2,643,039 A * 6/1953 Samuel ..... G10G 5/005 224/250
3,294,299 A * 12/1966 Brennan ..... A44C 19/00 224/220
4,610,476 A * 9/1986 Keiner ..... A44B 11/06 294/149
5,165,584 A * 11/1992 Meagher ..... A45F 3/14 124/88
5,868,293 A * 2/1999 D'Addario ..... A44B 11/266 224/250
6,216,319 B1 * 4/2001 Elkins ..... A45F 5/00 224/221
6,447,037 B1 * 9/2002 Crouch ..... B65D 33/14 294/149
7,235,731 B2 * 6/2007 Poff ..... G10G 5/005 84/274
D655,080 S * 3/2012 Burrows ..... D3/215
8,618,393 B1 * 12/2013 Peters ..... G10D 1/08 84/327
2011/0186606 A1 * 8/2011 Apthorp ..... G10G 5/005 224/257

* cited by examiner

*Primary Examiner* — Robert W Horn
(74) *Attorney, Agent, or Firm* — Thomas Schneck

(57) ABSTRACT

A guitar strap including lasso-like connectors at either end, allowing the strap to be fastened to the guitar by placing the sliding loops over the guitar's strap-buttons and pulling tight. A pull-tab near the sliding eye on the sliding loops is used to pull the loop back open and disconnect the strap end from the guitar. An elastic ring incorporated into the pull-tab stretches over the button head and fastens onto the button to prevent the sliding eye from loosening open when there is no tension on the strap. Each connector is positioned in a sling formed by folding a length of the strap band. The strap band has soft loop material on its surfaces and a section of hook tape fixed to either end to facilitate adjustment of the overall strap length. The tape adheres to nearly any location along the top surface of the band, allowing the length of the strap to be adjusted quickly in large or small increments. The loop material along both sides of the strap band allow users to affix hook-tape to a variety of objects such as wireless transmitters, audio recorders, and decorations and attach them to the strap as desired.

9 Claims, 7 Drawing Sheets

GUITAR STRAP

CROSS-REFERENCE TO RELATED APPLICATION

This application claims priority under 35 U.S.C. 119(e) from prior U.S. provisional application No. 62/097,912, filed Dec. 30, 2014.

TECHNICAL FIELD

The present invention relates generally to shoulder straps. More specifically, it relates to support straps for musical instruments, such as the guitar, on which strap-support pegs commonly referred to as strap-buttons are utilized.

BACKGROUND ART

The primary purpose of a guitar strap worn over the shoulder is to suspend the guitar securely in front of the guitar player. The length of the strap should be adjustable to allow for various combinations of guitar sizes, user heights, and playing positions. The ideal guitar strap is easy to attach and detach from the guitar, holds the guitar securely while attached, can be adjusted in length quickly and easily, is free from hard or rough edges that can scratch the guitar's surface, doesn't put any unnecessary torque or stress on the guitar, and is comfortable to wear for extended periods.

Currently, the most common guitar straps are made from a band of fabric or leather with ends containing slits which are pressed over the guitar's strap-buttons to connect the strap to the guitar. The means of adjusting the length of the strap is typically via a sliding buckle. One end of the strap is fixed to a slit-connector while a free end of the strap is threaded through the buckle. In order to slide the buckle's position, the user has to take the guitar off, loosen the threaded portion of the strap, adjust the length, and then put the guitar back on. The adjustment process is repeated until the desired overall length is achieved.

These common straps have significant drawbacks. A first drawback results from the means of connecting to the guitar via a slit in a piece of material, which is very often leather (or simulated leather). If the slit is too small, it is difficult to press the connecting piece over the guitar's strap-button. This is especially true when the connecting piece is made from thicker and less-pliable material. Sometimes significant force is required to press and pry the slit over the button head. This can place stress on the body of the guitar near the base of the button which can cause the button to strip out of its threads in the body, create localized cracks in the body material, or in some cases rip the button completely out. Conversely, if the slit is too big, the connection will not be as secure which can cause the connection piece to pull off of the strap-button unexpectedly, allowing the guitar to fall onto the ground and get damaged.

There are several different designs which have attempted to remedy these connection issues, and most fall under the category of 'locking' guitar straps. They typically feature some sort of mechanism which opens to receive the guitar's strap-button and closes tightly behind the button head. One example is found in U.S. Pat. No. 6,590,145 B2 which utilizes a keyhole in the connecting piece. A flexible tongue applies pressure to the button head to help keep it down in the narrow section of the keyhole. This design benefits from simplicity. However, with the fixed keyhole size, this strap attachment is limited in the variations of strap-button shapes and sizes it can accept. Another example is found in U.S. Pat. No. 7,888,572 B2 which has a lock-body to receive the button and a retainer latch to hold the button within the lock-body. The primary problem with this strap and strap attachment means is the fixed size of the lock-body, which again limits the variations of strap-buttons it can accept. Further, this strap utilizes multiple small components such as a pin, a spring, and a latch, which must be made from hard materials. If the chosen material is metal, there is risk of scratching the guitar. If the material is plastic, it must be sufficiently strong to hold its shape with even the heaviest of guitars while avoiding fatigue and stress failure. Still another example is found in U.S. Pat. No. 7,818,851 B2 which has a sleeve with a keyhole that receives the button and a slider which slides down behind the button head. This design, like Rosenberg's, benefits from a relatively simple design. However, like the others, it has a fixed keyhole size which limits compatible strap-buttons.

The second set of issues for common guitar straps result from the means of guitar strap length adjustment. Having to remove the guitar to adjust strap length is inconvenient and increases the risk of dropping the guitar. Additionally, since the user isn't wearing the strap during adjustment, it is difficult to tell how much adjustment is needed and multiple adjustments are often required to get the desired length. Finally, there are certain lengths that set the hard buckles in positions which will come in contact with the shoulder, leading to discomfort. U.S. Pat. No. 7,491,876 improves upon this by utilizing hook-and-loop fasteners on the strap ends, while also including a shoulder pad to help increase comfort. However, the free end of the strap with the thumb tab is on the bottom, padded side of the strap. This makes it somewhat awkward to grab the thumb tab and reposition the free end somewhere along the bottom surface. Additionally, the adjustable range is limited due to the user's body and the addition of the flexible cushioning pad.

SUMMARY DISCLOSURE

The present invention is directed to an improved guitar strap which overcomes the aforementioned issues and limitations.

The connector issues are overcome with a lasso-like sliding loop which opens to a wide diameter to receive a large variety of button sizes, pulls to cinch tightly around the button, and is naturally kept taught from the weight of the guitar. A pull-tab near the sliding-eye allows the user to easily open the loop to disconnect the strap end from the guitar. If needed, an elastic ring can be incorporated into the pull-tab to secure the sliding-eye and keep the connector from slipping open when there is no tension on it. These features together provide a secure, non-damaging means of connection which is quick and easy to use and is compatible with nearly any shape and size of strap-button.

Length adjustment is simplified by utilizing hook-and-loop fastening materials. The top and bottom surfaces of the strap band are constructed with loop fastening material. Mating hook pieces are attached to the free ends of the band such that the hook ends adhere to the top side of the strap band when the band is folded back over onto itself. This allows convenient length-adjustment from the easily-accessible top side of the strap for front and rear adjustment while wearing the guitar. Adjustment is achieved by unfastening a free end from the surface of loop fastening material and repositioning it further up or down along the surface. The connection assembly slung between the end of the strap band and main portion of the strap band moves accordingly.

The inclusions of loop fastening material on the bottom surface as well as the top surface is preferred. This creates a large adhesion surface which can be utilized for attaching other items to the strap by first affixing mating hook pieces to the item. Some examples where this would be desirable are wireless signal transmitters, audio recorders, pick holders, and decorations. Items which are cosmetically undesirable, such as wireless signal transmitters and pick holders, could be affixed out of view on the bottom surface while decorative items could be affixed to the top surface.

DETAILED DESCRIPTION

Figure 1:
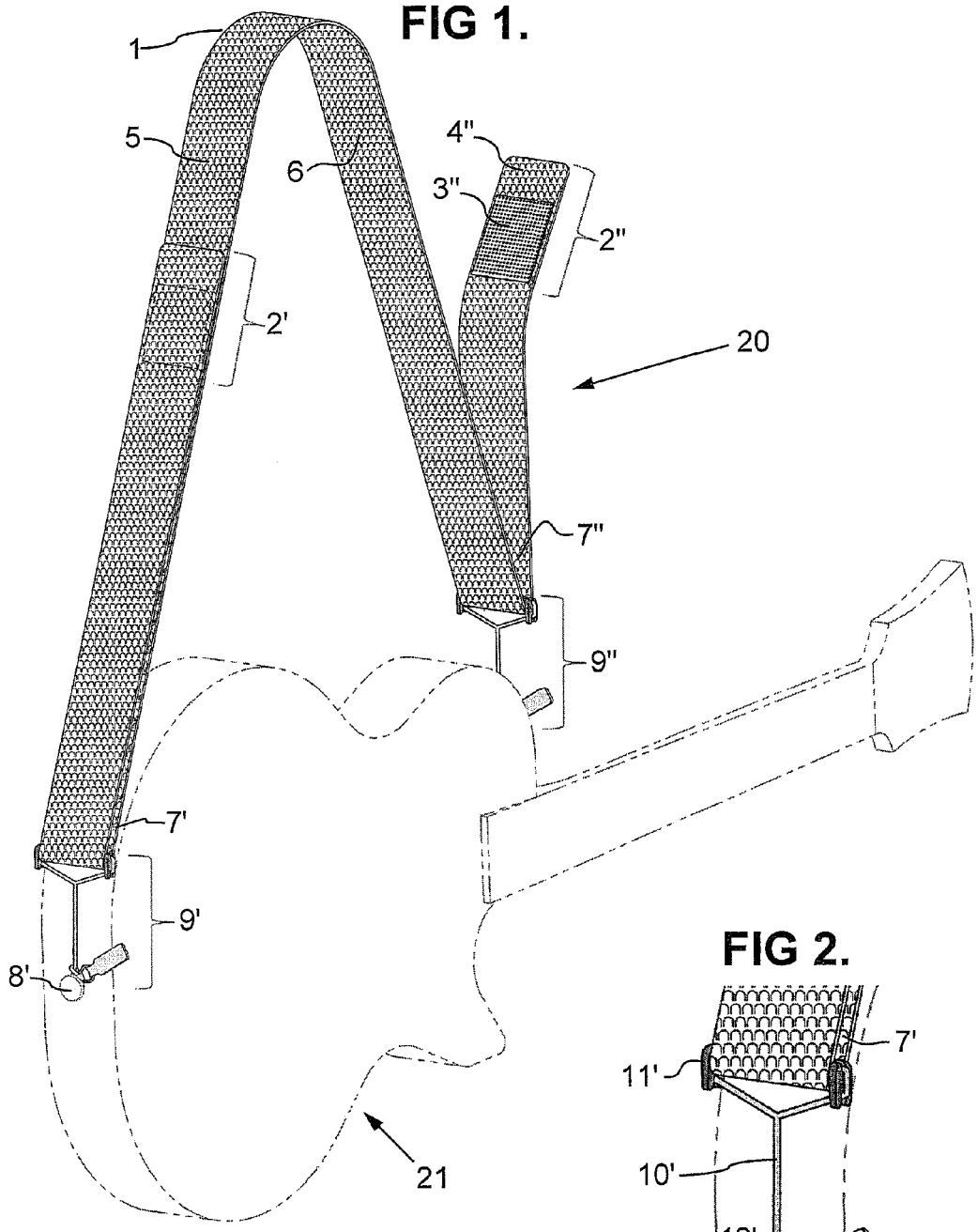
FIG. 1 is a perspective view of a guitar connected to a guitar strap with the elastic ring of the pull-tab disengaged and showing the rear adjustment end adhered to the top of the strap band while the front adjustment end is unfastened and free to adjust up or down.

The present strap connects and disconnects easily, is compatible with a wide range of strap-button shapes and sizes, stays securely connected under energetic use with light and heavy guitars, is easy to adjust its overall length while wearing the guitar, and has few if any hard parts in order to protect the guitar's finish.

Referring now to the drawings, like reference numbers indicate identical features which are generally symmetrical about the middle of the strap. When the presented view depicts the rear of the strap, a single prime indicator is used and when the presented view depicts the front of the strap a double prime indicator is used. When the presented view does not have any indication of front or rear depiction, no prime indicators are used.

FIG. 1 depicts the guitar strap 20 as it is connected to a guitar 21 via the strap's rear connection-assembly 9' and front connection-assembly 9", which are in turn connected to the guitar's strap-buttons, the rear one of which is shown as 8'. The strap band 1, having a top loop-surface 5 and a bottom loop-surface 6, is threaded through the connection assemblies 9' and 9" and folded back onto itself at either end to form a rear support-sling 7' and a front support-sling 7". The front end of the strap band 2" is in an unfastened position to show the attached piece of fastening-hook material 3" and a thumb-grab area 4" which is free from fastening-hook material such that the user can easily grab hold of the strap end and unfasten it. The rear end of the strap band 2' is shown in the fastened position.

Figure 2:
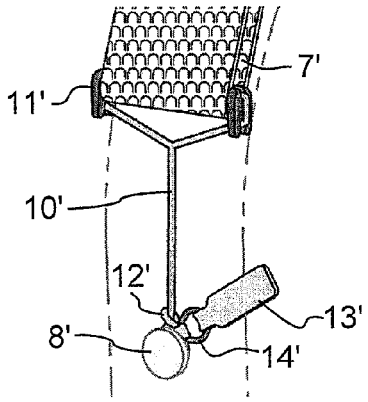
FIG. 2 is a front detail view of the strap-button connection assembly, from the same perspective angle as FIG. 1.

FIG. 2 presents the connection-assembly from a rear view more closely. A flexible cord 10 is supported by a rigid support-member 11 resting in the rear support sling 7'. The cord is threaded through a sliding-eye 12' at the end of the cord to form a lasso-like loop which can cinch around the guitar's strap-button 8'. A pull-tab 13' is attached near the sliding-eye such that the user can pull open the lasso-like loop in order to disengage the connection-assembly from the guitar. An elastic ring 14' is included at the base of the pull-tab such that the elastic ring can be stretched around the. strap-button to keep the lasso-like loop from sliding open when there is no tension on the flexible cord.

Figure 3:
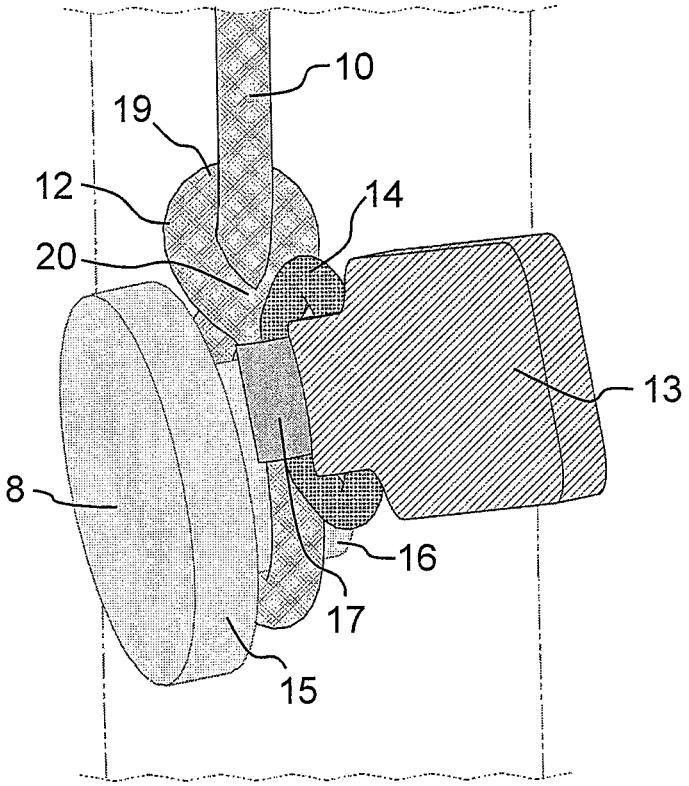
FIG. 3 is detail view of the bottom end of the connection assembly from an angle to show where the lasso-like loop is engaged around the guitar's strap-button while the elastic ring of the pull-tab remains disengaged.

FIG. 3 shows the bottom end of the connection-assembly in a close-up view which does not indicate a rear or font depiction. The flexible cord 10 is threaded through the sliding-eye 12 which has a free end 19 and an adjoining end 20, to form a lasso-like loop which is cinched around the guitar's strap-button 8 having a button head 15 that is wider than the button neck 16. A pull-tab 13 with an elastic ring 14 is attached to the flexible cord near the adjoining end of the sliding-eye by an attachment means 17.

The means of connection (the lasso-like loop) of the strap to the guitar has not been utilized in guitar straps to date because a guitar's strap-button has a very shallow profile. This precludes the use of a flexible material which, if sufficiently strong to hold up a guitar, would be too thick to nest in the shallow profile created by the strap-button. Commonly in a guitar the strap-button has a short neck, commonly measuring about 3 mm to 4 mm between the head of the button and the guitar body. A lasso that is strong enough to hold the guitar would generally require a cord that is too thick. The present invention is based on a discovery that certain braided materials (such as braided aramid or polyethylene fibers) allow the lasso-like loop to be used.

The diameter of the lasso's flexible cord should be no larger than 4 mm or it will not fit within the neck area of the guitar's strap-button. 4 mm is a maximum, as that leaves no room for the attachment means and is a 'typical' clearance between a button head and the guitar body. A common clearance range is between 3 mm at a minimum and 6 mm at a maximum. Therefore, keeping the cord diameter at 3 mm or less is ideal as it will fit all buttons. A preferred diameter of the flexible cord is between 1 mm and 2 mm to allow for increased thickness near the sliding-eye's adjoining end due to the pull-tab's attachment means.

In one embodiment, the lasso's flexible cord has a hollow core. This allows a 'bury splice', i.e., a splice into the hollow core to create a 'sliding-eye' as shown in FIG. 3. The flexible cord is made from braided construction (For example 8-16 strand, and in one embodiment 12-strands). Using this number of strands allows the creation of the bury splice sliding-eye in dimensions suitable for use with common strap-button clearance. The flexible cord is made from aramid or polyethylene fibers, which are many time stronger than steel. The use of such cords makes possible a sufficiently small diameter cord to be strong enough to hold the weight of the guitar. The elastic ring is made from 'shock cord' which has multiple elastic strands (like rubber bands) as a core and is covered in a woven sheath of polypropelene.

The diameter of the shock cord for the elastic ring is preferably between 1.5 mm and 3.5 mm. If the elastic ring were any smaller and it would be too flimsy and could break when the ring is used to remove the strap from a button. If the ring were of a greater diameter and the cord becomes impractically difficult to fit over the button on the guitar body. The diameter of the opening of the elastic-ring must be about 12 mm for the optimal balance of tension and ease of getting it over the button head. A range of 6 mm to 20 mm is acceptable.

Figure 4:
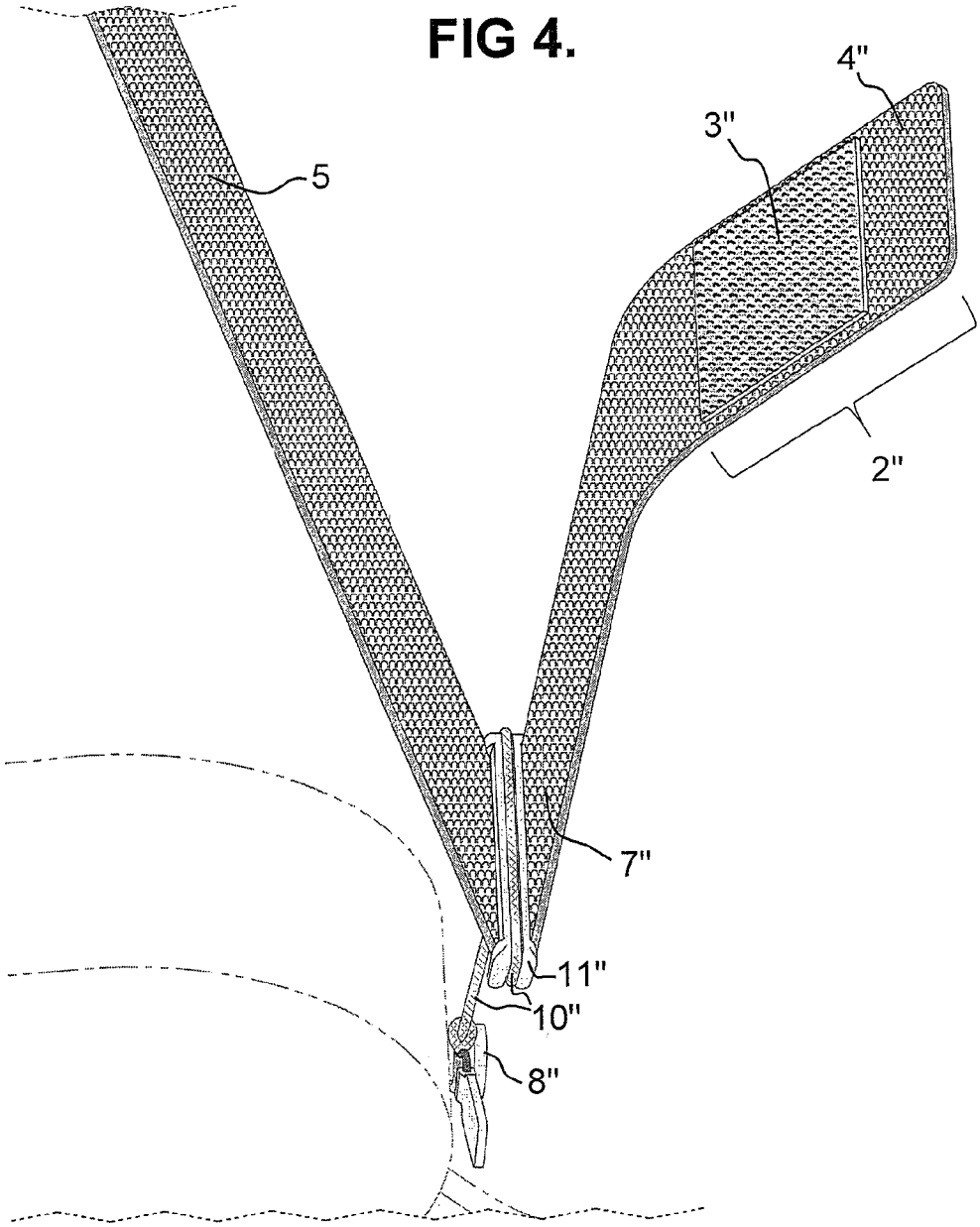
FIG. 4 is a detail view of an unfastened end of the strap band displaying the attached hook piece, the top loop-surface of the strap band to which the hook piece adheres to, and the connection assembly slung between the free end and the main portion of the strap band.

FIG. 4 shows the rigid support-member 11" more closely which rests in the front support sling 7". The flexible cord 10" is shown to be supported by the rigid support member within the sling while connected to the guitar's front strap-button 8". The piece of fastening-hook material 3" on the end of the strap band 2", which adheres to the loop surface 5, is shown more closely along with the thumb-grab area 4".

Figure 5:
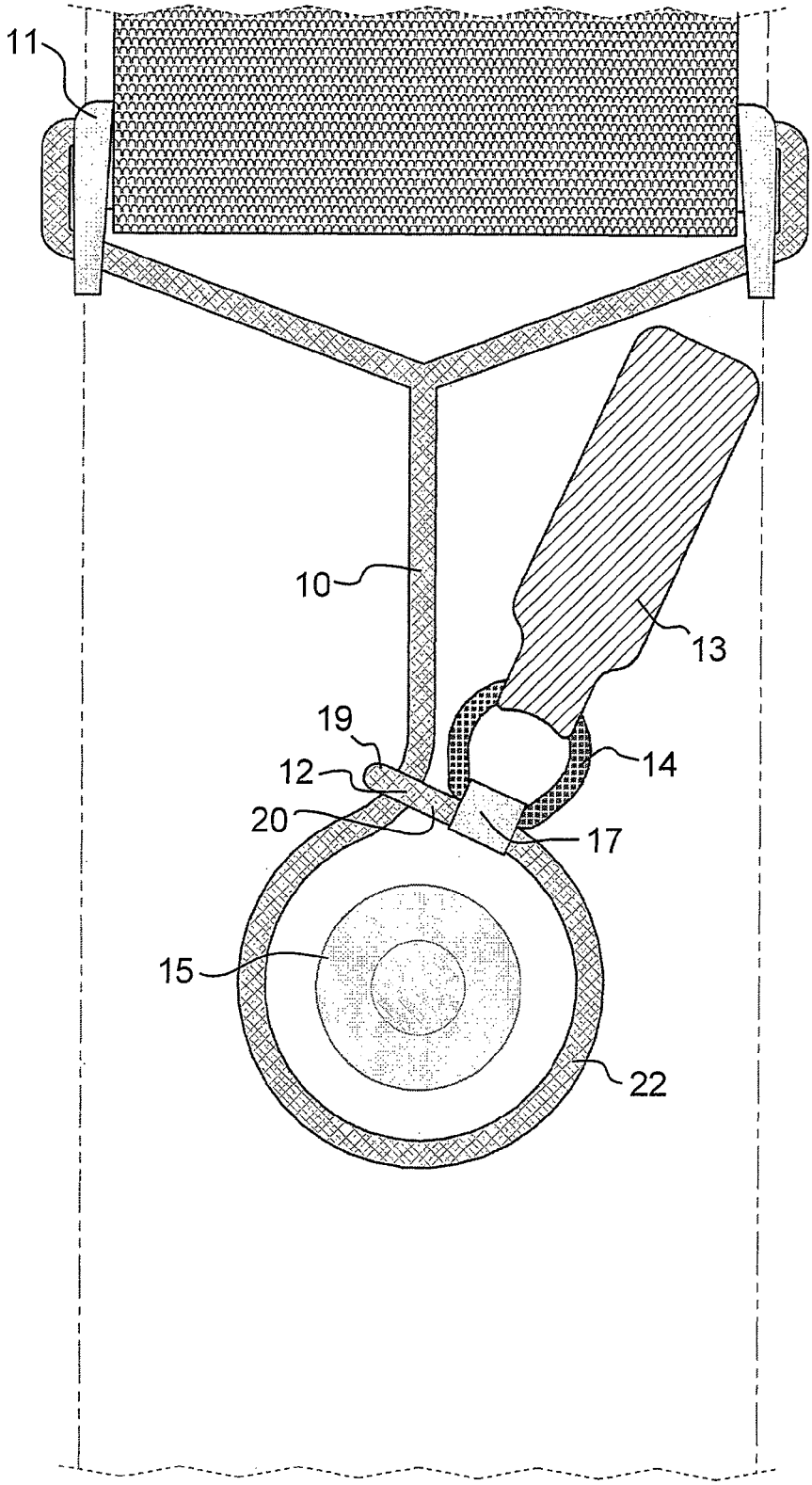
FIG. 5 is a detail view of the connection assembly with the lasso-like loop open to engage with or disengage from the strap-button, which is showing an outline of the hidden neck portion that is attached to the guitar body, while the elastic ring of the pull-tab remains disengaged.

FIG. 5 shows the connection-assembly in a close-up view which does not indicate a rear or font depiction where the lasso-like loop 22 is in the open position to fit over the guitar's strap-button head 15. The flexible cord 10 is shown to be supported by the rigid support-member 11 and is threaded through a sliding-eye 12 with indications of the sliding-eye's free end 19 and the sliding-eye's adjoining end 20. The pull-tab 13, with its elastic ring 14, are shown to attach near the adjoining end of the sliding-eye through a means of attachment 17.

Figure 6:
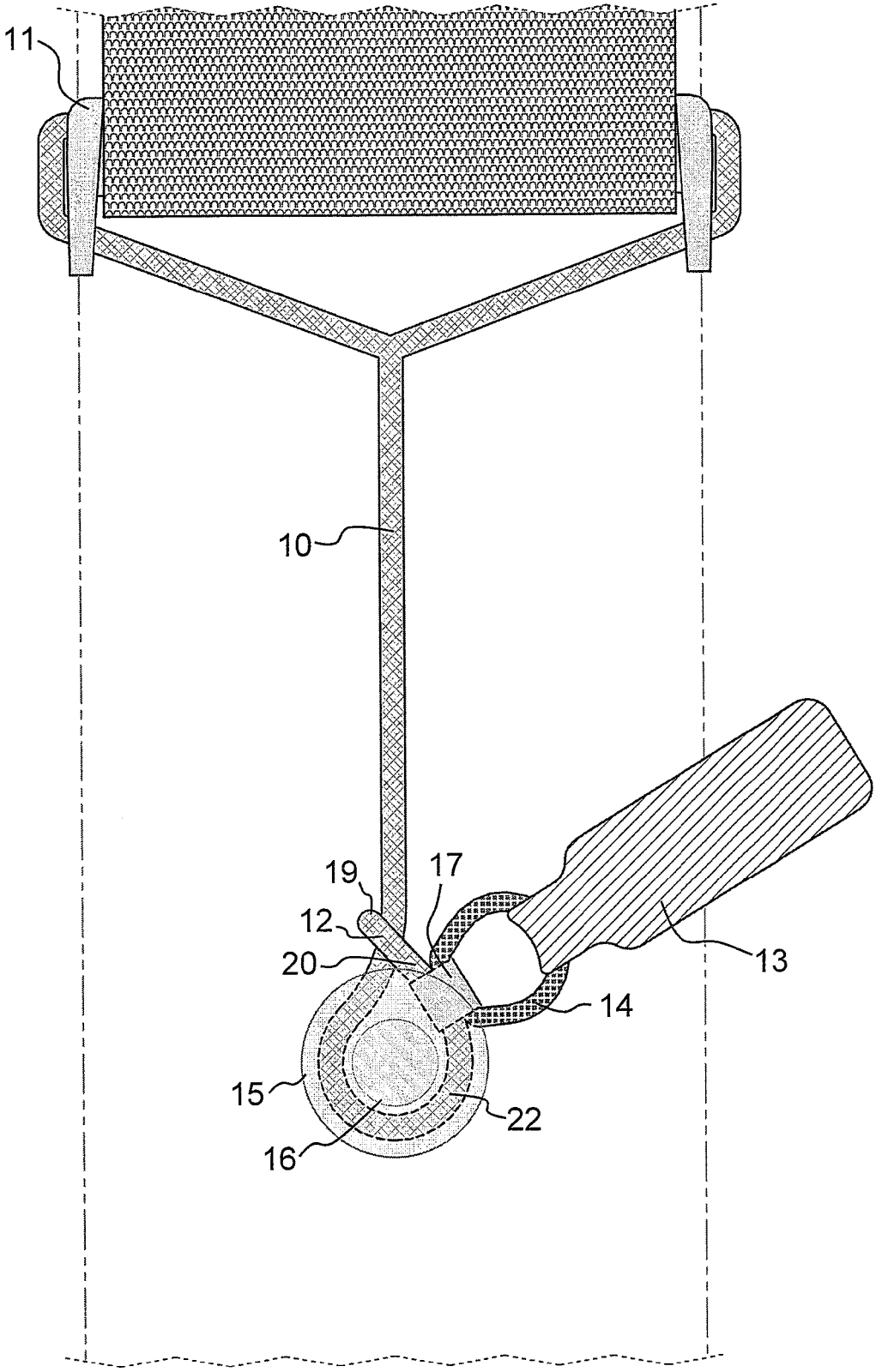
FIG. 6 is a detail view of the connection assembly with the lasso-like loop engaged with the strap-button, cinched around the hidden neck portion of the strap-button, while the elastic ring of the pull-tab remains disengaged.

FIG. 6 shows the connection-assembly in a close-up view which does not indicate a rear or font depiction where the lasso-like loop 22 is cinched around the guitar's strap-button neck 16. The flexible cord 10 is shown to be supported by the rigid support-member 11 and is threaded through a sliding-eye 12 with indications of the sliding-eye's free end 19 and the sliding-eye's adjoining end 20. The pull-tab 13, with its elastic ring 14, are shown to attach near the adjoining end of the sliding-eye 20 through a means of attachment 17.

Figure 7:
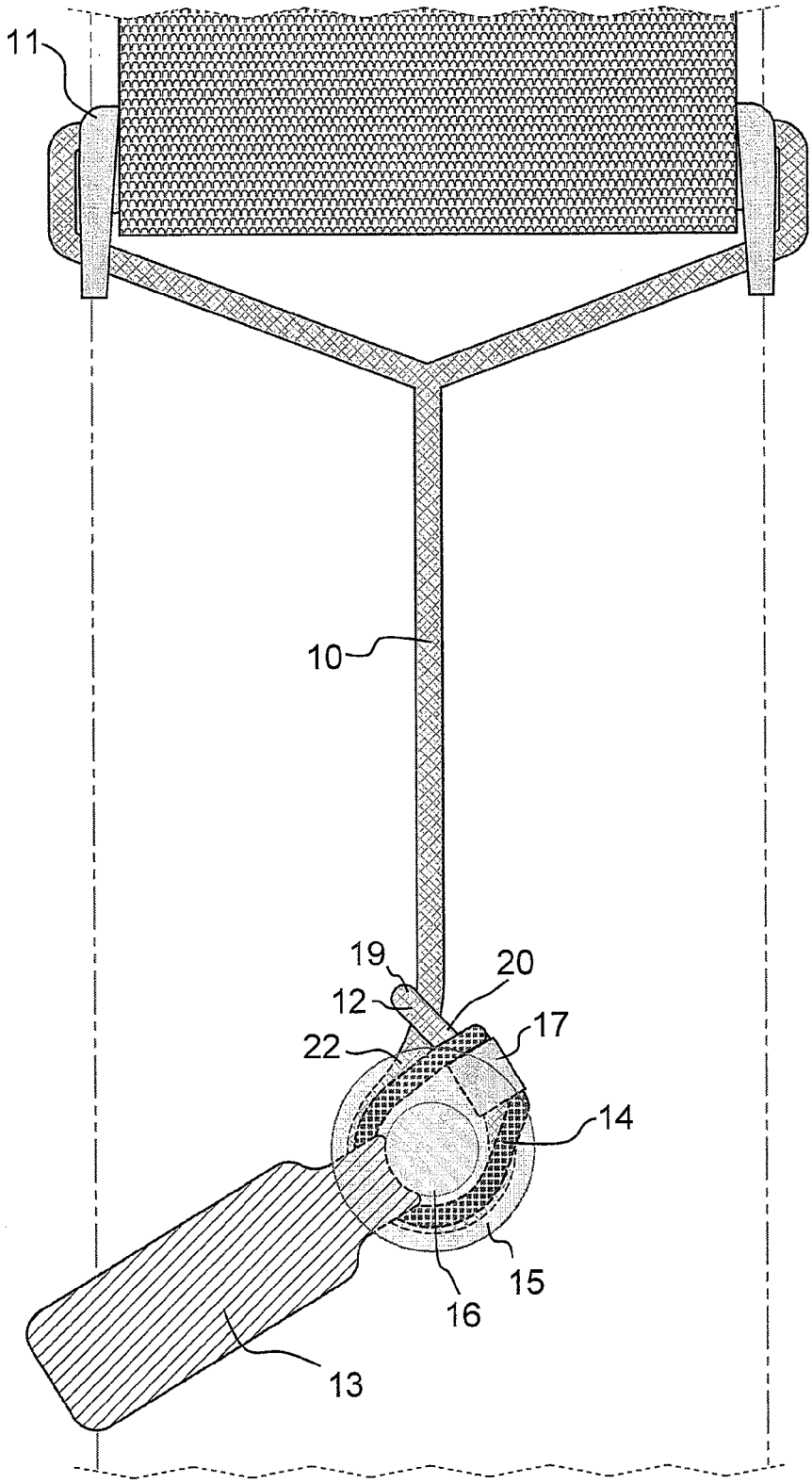
FIG. 7 is a detail view of the connection-assembly with the lasso-like loop engaged with the strap-button, cinched around the hidden neck portion of the strap-button, with the elastic ring of the pull-tab secured around the neck of the strap-button after having been stretched around the head of the strap-button.

FIG. 7 shows the connection-assembly in a close-up view which does not indicate a rear or font depiction where the lasso-like loop 22 is cinched around the guitar's strap-button neck 16. The flexible cord 10 is shown to be supported by the rigid support-member 11 and is threaded through a sliding-eye 12 with indications of the sliding-eye's free end 19 and the sliding-eye's adjoining end 20. The elastic-ring 14 is shown secured around the guitar's strap-button neck 16 after having been stretched over the strap-button head 15. The pull-tab 13 is shown to attach near the adjoining end of the sliding-eye 20 through a means of attachment 17.

Figure 8:
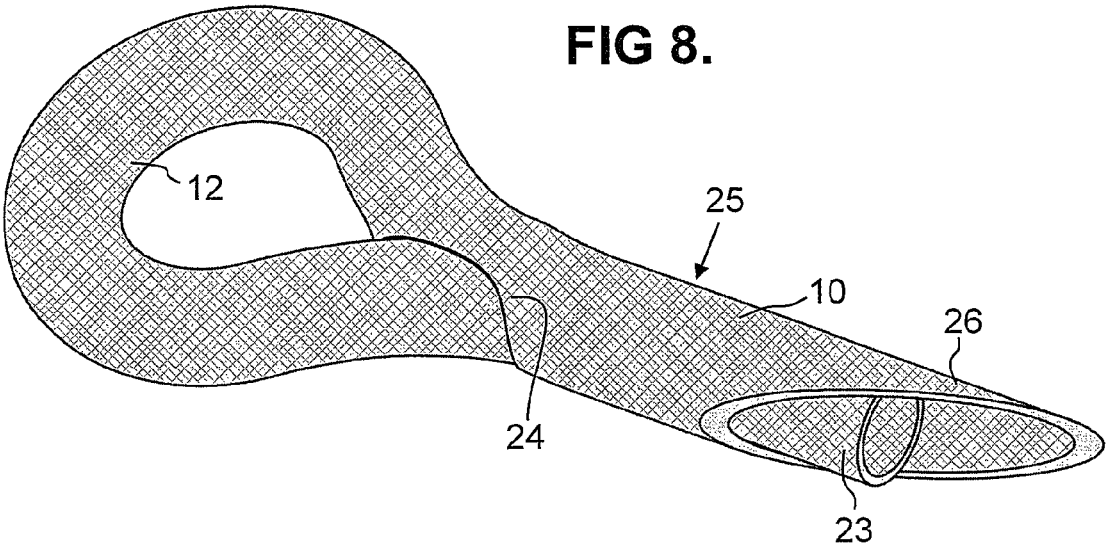
FIG. 8 is a detail view of the sliding-eye at the end of the flexible cord where the flexible cord is threaded through in order to create the lasso-like loop.

FIG. 8 is a close-up view of the sliding-eye 12 within the end portion of the flexible cord 10 which is hollow and has a sleeve-end 26 with an opening 24 through which the bury-end 23 is threaded and buried deep within the sleeve to create diameter 25.

I claim:

1. A guitar strap attachable onto front and rear guitar strap-buttons on a guitar, said guitar strap comprising:

a guitar strap band having a first end and a second end;

a front, braided flexible cord having a front lasso-loop end dimensioned to fit within a clearance space of said front guitar strap-button and a front strap-band sling end providing an attachment width for a front end of said guitar strap band; and a rear, braided flexible cord having a rear lasso-loop end dimensioned to fit within a clearance space of said rear guitar strap-button and a rear strap-band sling end providing an attachment width for a rear end of said guitar strap band.

2. The guitar strap of claim 1, wherein each of said front lasso-loop end and rear lasso-loop end of each of said front and rear braided flexible cords includes a pull-tab affixed onto each of said front and rear lasso-loop.

3. The guitar strap of claim 2, wherein each pull-tab is connected to an elastic ring, and each elastic ring is attached to one of said front and rear lasso-loop.

4. The guitar strap of claim 1, wherein said guitar strap band is made of two sides of loop type material, and front and rear ends of said guitar strap band have a front and rear section of hook type material.

5. The guitar strap of claim 1, wherein said front braided flexible cord and said rear braided flexible cord are each between 1 and 4 millimeters in diameter.

6. The guitar strap of claim 3 wherein the opening of each of said elastic rings has a diameter between 6 and 20 mm.

7. The guitar strap of claim 1, wherein said front braided flexible cord and said rear braided flexible cord are each comprised of between 8 and 16 strands and are made from a material selected from a group consisting of aramid and polyethylene.

8. The guitar strap of claim 4, wherein said front and rear sections of hook type material are spaced from ends of said guitar strap bands such that said ends may function as pull tabs.

9. The guitar strap of claim 1, wherein each of said front and rear strap-band sling includes a rigid support member extending across a width of said guitar strap band.

* * * * *